US006659918B2

(12) United States Patent
Schiessl

(10) Patent No.: US 6,659,918 B2
(45) Date of Patent: Dec. 9, 2003

(54) DEVICE FOR STIMULATING MUSCLES

(76) Inventor: Hans Schiessl, Markgrafenstrasse 8, D-75177 Pforzheim (DE)

( * ) Notice: Subject to any disclaimer, the term of this patent is extended or adjusted under 35 U.S.C. 154(b) by 0 days.

(21) Appl. No.: 09/734,679

(22) Filed: Dec. 13, 2000

(65) Prior Publication Data

US 2001/0000782 A1 May 3, 2001

Related U.S. Application Data

(60) Division of application No. 09/231,360, filed on Jan. 13, 1999, now Pat. No. 6,217,491, which is a continuation-in-part of application No. PCT/EP97/04475, filed on Aug. 16, 1997.

(30) Foreign Application Priority Data

Aug. 26, 1996 (DE) ..... 196 34 396
Aug. 26, 1996 (DE) ..... 196 34 397

(51) Int. Cl.[7] ..... A63B 21/22; A61H 1/00

(52) U.S. Cl. ..... 482/92; 482/148; 482/110; 601/23

(58) Field of Search ..... 482/91, 92, 148, 482/110, 139, 106, 107, 108, 109, 33, 146; 601/23, 72, 67, 73, 80, 82; 79/5 R

(56) References Cited

U.S. PATENT DOCUMENTS

| | | | | |
|---|---|---|---|---|
| 850,938 | A | 4/1907 | Kellogg | |
| 1,013,782 | A | 1/1912 | Koch | |
| 1,058,786 | A | 4/1913 | Newkirk et al. | |
| 1,709,410 | A | 4/1929 | Simmons | |
| 2,235,183 | A | 3/1941 | Wettlaufer | 128/52 |
| 2,349,743 | A | 5/1944 | Meyer | 128/32 |
| 2,629,373 | A | 2/1953 | Laustedt | 128/33 |
| 3,077,869 | A | 2/1963 | Houbeau et al. | 128/33 |
| 3,140,711 | A | 7/1964 | McGathey | 128/33 |
| 3,307,534 | A | 3/1967 | Gibbs | 128/25 |
| 3,540,436 | A | 11/1970 | Hueftle | 128/25 |
| 3,581,739 | A | 6/1971 | Brandt et al. | 128/44 |
| 3,617,056 | A | 11/1971 | Herbold | 272/84 |
| 3,667,453 | A | 6/1972 | Schenck et al. | 128/24 R |
| 3,817,243 | A | 6/1974 | Perrine | 128/57 |
| 4,151,839 | A | 5/1979 | Schwarz | 128/52 |
| 4,989,857 | A | 2/1991 | Kuo | 272/70 |
| 5,112,045 | A | 5/1992 | Mason et al. | 482/9 |
| 5,298,002 | A | 3/1994 | Lin | 482/53 |
| 5,429,562 | A | 7/1995 | Milner | 482/51 |
| 5,443,439 | A | 8/1995 | Ohshita | 601/90 |
| 5,468,215 | A | 11/1995 | Park | 601/23 |
| 5,500,002 | A | 3/1996 | Riddle et al. | 606/242 |
| 5,755,651 | A | 5/1998 | Homyonfer et al. | 482/146 |

FOREIGN PATENT DOCUMENTS

RU 1344-356 A 4/1982

*Primary Examiner*—Stephen R. Crow
(74) *Attorney, Agent, or Firm*—Morgan, Lewis & Bockius LLP

(57) ABSTRACT

A device and method is shown for invoking a muscle's natural involuntary, reflexive response or stretch reflex by imparting a sudden increase in load on the muscle over a defined period of time from a predetermined base load at which the muscle has assumed a baseline tonus, and over a predetermined amplitude of motion. The muscle is stimulated by cycling the load with a frequency of between 1 and 60 Hz, or more preferably between 10 and 30 Hz, and an amplitude of displacement of the muscle between 2 and 50 mm, or more preferably between 5 and 10 mm. The force input to the muscle can be provided by either the mass of the body to which the muscle is connected or by an external mass or resistance to motion. A seesaw platform can be oscillated in a vertical direction at the correct frequency and amplitude. Alternatively, a surface adapted to be fixed to a portion of the body can be oscillated relative to an external mass or other element that resists motion due to gravitational, frictional or inertial forces.

16 Claims, 5 Drawing Sheets

FIG. 1A
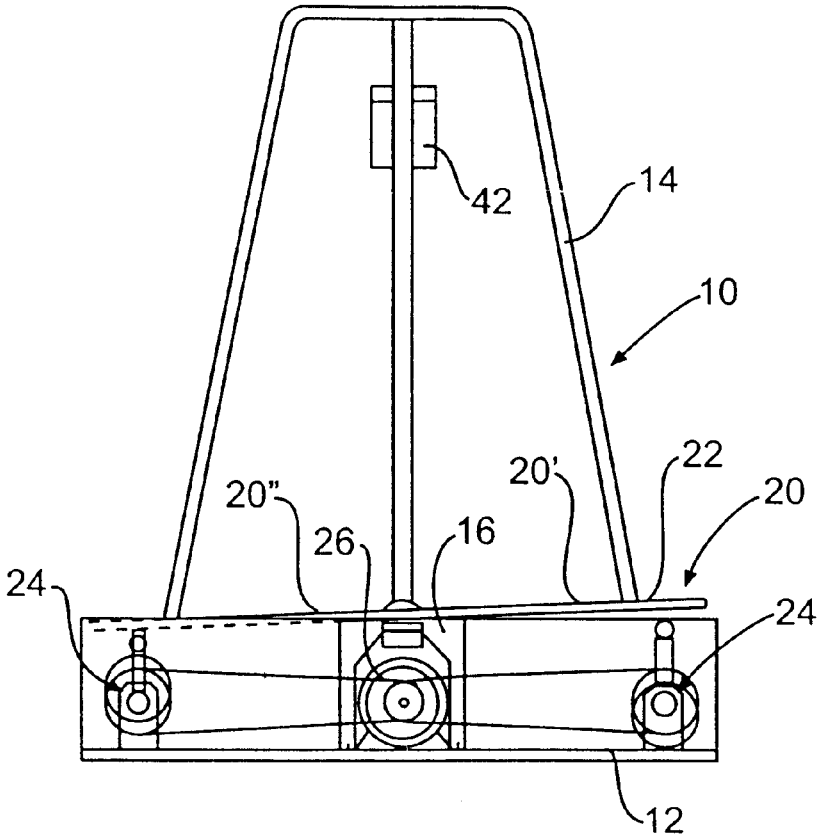
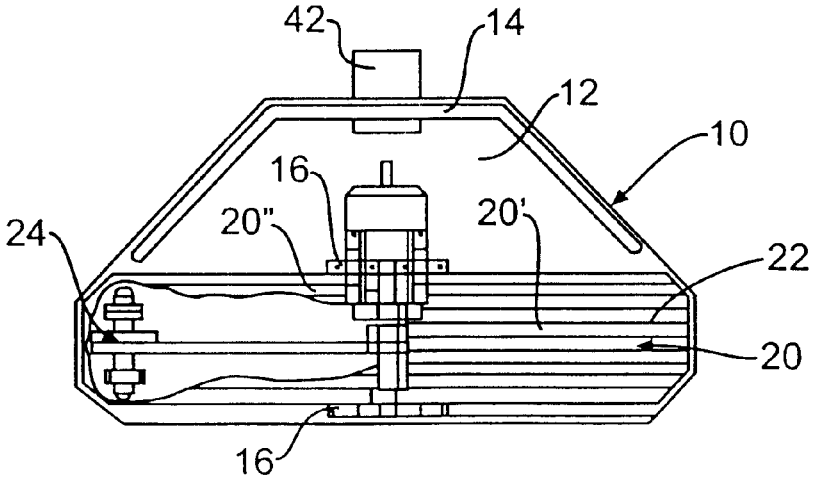
FIG. 2A

DEVICE FOR STIMULATING MUSCLES

This is a divisional application of U.S. patent application Ser. No. 09/231,360, filed on Jan. 13, 1999, now U.S. Pat. No. 6,217,491, issued on Apr. 17, 2001, which in turn is a continuation-in-part application of International Application No. PCT/EP97/04475, filed on Aug. 16, 1997 and which designated the U.S.

BACKGROUND OF THE INVENTION

1. Field of the Invention

The present invention relates to a device and method for stimulating muscles. More particularly, the invention relates to a device and method for stimulating muscles to maximize muscular development while minimizing required physical exertion and stress on the muscles, respiratory system, and cardiovascular system.

2. Description of the Related Art

Existing exercise machines generally provide a means for offering resistance to voluntary movement of various limbs of the body, or in some devices, provide a means for imparting motion to various parts of the human body when the body is in a relaxed, passive state. U.S. Pat. No. 5,273,028 to McCleod et al. (McCleod) discloses a method and apparatus that allegedly promotes bone tissue growth by imparting a mechanical load to the bone tissue. The McCleod device includes upper and lower rigid plates with spring means positioned between the plates to support the upper plate relative to the lower plate, and dynamic force transducers positioned between the plates to vertically drive the upper plate with respect to the lower plate. The spring means between the plates is selected such that the natural frequency of the device in combination with a body positioned on the upper plate will fall into the range between 10 and 50 Hz. The upper plate always remains parallel to the lower plate, with the peak-to-peak vertical displacements imparted by the dynamic force transducers between the plates being limited to no greater than 2 mm such that the strain induced on a body positioned on the upper plate will not exceed 500 microstrain. McCleod discloses that in order to minimize the chance of injury to the patient and bone tissue being treated, the peak-to-peak dynamic acceleration imparted to the body by the device should not exceed 0.3 g (corresponding to a peak-to-peak displacement of 2.0 mm). The McCleod device and method is designed to drive the combination of the upper plate and a body standing on the upper plate in a vertical direction and at its natural resonant frequency. The sole purpose of the McCleod device is to generate a load on the bone tissue that mimics a load generally created on the bone tissue by certain muscle contractions. The McCleod device does not provide any beneficial development of the muscles themselves or of the neural patterns characterizing normal patterns of movement of the body.

Soviet Union Publication 1344356 (SU '356) discloses a method of stimulating muscles using a combination of electrical and vibration stimulation. SU '356 does not disclose an apparatus for performing the stimulation other than to indicate that a cord and block attached to a vibro-stimulator can be used in order to raise a limb up to an accessible position. The vibro-stimulation is always performed on the muscle-antagonist, while the electro-stimulation is performed on the muscle-synergist (muscle-protagonist). A user of the method taught by SU '356 flexes a muscle while synchronized vibration and electrical stimulation is conducted. The vibro-stimulation is transferred to the muscle-antagonist in order to assist in expansion of the muscle-antagonist. Under the influence of vibro-stimulation, an increase in the amplitude of the expansion of the muscle-antagonist takes place, while under the influence of electro-stimulation, the concentric contraction of the muscle-synergist (or muscle-protagonist) increases, which leads to an increase in the active and passive mobility of the area around the muscles.

U.S. Pat. No. 3,540,436 to Hueftle (Hueftle) discloses a machine having a pair of vertically movable footboards that are arranged parallel to each other with the bottoms of the rear ends of each of the footboards riding on rotatable cams that provide alternating reciprocating vertical movement of the footboards. The alternating movement of the footboards is performed to simulate a walking motion and is therefore performed at a very low frequency. The amount of vertical movement of the rear ends of the footboards is limited by the eccentricity of the rotatable cams, and therefore the only adjustment of amplitude of movement for a user is achieved by the user moving closer to or farther away from the rear ends of the footboards.

U.S. Pat. No. 5,500,002 to Riddle et al. (Riddle) discloses a passive motion physical therapy device having a centrally located body support member for supporting the buttocks of a patient and hingedly attached support members on both sides of the centrally located body support member for supporting the upper and lower torso of the patient. Two actuators driven by a single motor are provided with displacement cams that allow the upper and lower torso support members to be simultaneously oscillated either in phase or out of phase. The device taught by Riddle is simply a passive motion physical therapy device that moves portions of the body of a patient without resulting in any contraction of the muscles.

U.S. Pat. No. 5,755,651 to Homyonfer et al. (Homyonfer) discloses an exercise device having a plate that can be pivoted about a central axis with energy absorbing elements connected to both ends of the plate to provide a desired degree of resistance to pivotal movement of the plate about its central axis. A user of the Homyonfer device places at least one foot on the pivotal plate with a heel toward one end of the plate and the toes toward the opposite end of the plate. An exercise movement consists of raising the heel and applying pressure with the toes or applying pressure with the heel and raising the toes. The user exercises by applying a moment to the pivotal plate against the resistance of the energy absorbing elements.

U.S. Pat. No. 850,938 to Kellogg (Kellogg) discloses a dumbbell housing an electric motor that drives a shaft connected to an eccentric mass such that when the shaft is rotated by the motor the dumbbell is vibrated.

None of the conventional exercise machines provide a method or device for stimulating a muscle or group of muscles in the proper manner to promote rapid development of the muscles while minimizing stress on the musculature, respiratory and cardiovascular systems. Existing exercise machines also do not provide a means for stimulating muscles in a manner that allows for rapid development of the neural patterns associated with a body's natural movements.

SUMMARY OF THE INVENTION

In view of the deficiencies of the above-discussed related art devices, the present invention has been developed to stimulate muscles in a manner that promotes rapid development of the muscles while minimizing the need for conscious exertion and minimizing stress on the musculature, respiratory and cardiovascular systems. The invention invokes a muscle's natural involuntary, reflexive response or stretch reflex by imparting a sudden increase in load on the muscle over a defined period of time from a predetermined base load at which the muscle has assumed a baseline tonus, and over a predetermined amplitude of motion. The stimulation of an involuntary reflexive response or stretch reflex of the muscle can be repeated many times over a relatively short period of time, yielding substantial benefits in muscular development as well as development of the neural patterns associated with various movements of various parts of the body.

The method of stimulating muscle according to an aspect of the present invention maximizes the rate of development of the muscle while minimizing strain. Activation of a muscle or a group of muscles occurs by increasing a force input to the muscle or group of muscles from a baseline force at which the muscles have assumed a desired baseline tonus to a peak force over a predetermined period of time and while moving the muscles through a predetermined amplitude of motion. The input force is then reduced from the peak force back to the baseline force, where it is maintained for a predetermined time interval before a subsequent activation.

The time for activation of the muscles from a baseline input force to the peak force and back to the baseline force is predetermined in order to stimulate the muscles' involuntary natural reflexive responses or stretch reflexes. The various muscles of the body used in performing normal movements such as walking or running exhibit their natural reflexive responses as a body maintains its balance through proprioception, or the unconscious perception of movement and spatial orientation arising from stimuli within the body such as tensions within the tissues of the body. When a force is input to a portion of a body, muscles connected through tendons to that portion of the body can influence the resulting motion of that portion of the body. The muscles that contract in a stretch reflex to act directly against the input force are the muscle-protagonists, while the muscles that must expand in order to allow the portion of the body to move against the input force are the muscle-antagonists.

If a force acts on a muscle or group of muscles, imparting a predetermined amount of movement to the affected muscles, and then is removed over a proper period of time, the muscle-protagonists react by contracting and the muscle-antagonists expand in involuntary reflexive responses or stretch reflexes. According to an aspect of the present invention, the involuntary reflexive response of muscles is exploited in order to maximize the development of the muscles without requiring a voluntary exertion on the part of the subject.

A series of reflexive responses in the muscles can be stimulated by a continuous cycling of activations from a baseline input force to a peak input force and back to the baseline input force with the muscles being moved through a sufficient amplitude of displacement. The frequency of muscle activations according to the present invention is determined by the muscle's stretch reflex time and the desired time interval between successive activations of the muscle. Because a muscle's typical stretch reflex time is on the order of 20 milliseconds, many successive activations can be performed in a relatively short period of time, increasing the efficiency of muscle development according to the method of the present invention. Input of the desired activation force to the muscle can be achieved by moving the body or a portion of the body against its own weight and inertia, or by adding the input of an external force acting on the body.

In an aspect of the invention wherein the body's own weight is used to provide the input force to the muscles, the body can be placed on a suitable drive mechanism. In an embodiment of the invention using the body's own weight or inertia to provide the input force to the muscles, two stepping surfaces are disposed on a frame and adapted to be oscillatingly lifted and lowered in a push-pull fashion by means of a drive mechanism. The selected limbs of a human or other animal such as a race horse are placed on the stepping surfaces and a baseline input force determines the tone of the muscles in the limbs positioned on the stepping surfaces. The baseline tonus of the muscles can be varied by having the subject assume different positions on the stepping surfaces such as a partial squat position, and/or by placing an additional static mass on the subject. The stepping surfaces are moved to a predetermined peak amplitude over a predetermined period of time in order to stimulate the muscles' natural involuntary reflexive response. The stepping surfaces are preferably moved out of synchronization with each other so that the body's proprioception is accessed by an unconscious effort to avoid a shift of the center of gravity of the body. Alternating, vertical reciprocating motion of the stepping surfaces over a sufficient amplitude of displacement causes the reflexive responses in the muscles and stimulates the neural patterns characteristic of natural movement of the body such as walking or running.

Since most muscles involved in movement of the body have a response and decay time in the order of approximately 10 milliseconds, the activation frequency of the stepping surfaces is adapted to conform to the muscles' natural reflexive response times. According to an aspect of the invention, a control device for controlling the drive mechanism is provided having an adjustable lifting frequency that can set the lifting frequency for the step surfaces to a value between approximately 1 and 60 Hz. More preferably, the device controls the frequency of activation between approximately 10 and 30 Hz. The amount of movement imparted to the muscles is also preferably set within the range of 2–50 mm, and more preferably 5–10 mm.

According to another aspect of the invention, the desired activation of the muscles in order to stimulate their natural involuntary reflexive responses can be achieved by superimposing oscillatory motion of an external mass onto a body's voluntary movements. In accordance with this aspect of the invention, standard exercising equipment such as dumbbells, barbells, and other progressive resistance exercise machines including, but not limited to, machines sold under the trademarks "UNIVERSAL," "LIFECYCLE" and "NAUTILUS" can be modified to include the superimposed oscillatory motion. The input forces exerted on the muscles by the oscillating external mass can be provided along the same or different axes as the axes along which the progressive resistance is exerted.

Whether activation of the muscles is achieved by oscillatory motion of the body itself or by superimposing oscillatory motion of an external mass on the body, the frequency and amplitude of the oscillations are predetermined in order to stimulate the muscles' natural involuntary reflexive responses or stretch reflexes. The desired frequency of activation (with one complete cycle including the time from a baseline input force to the peak force and back to the baseline force as well as the time before the next activation) is between approximately 1 and 60 Hz, and more preferably between 10 and 30 Hz. Furthermore, the amplitude of the oscillatory movement needed to achieve the desired results is in the range of approximately 2 to 50 mm., and more preferably in the range of approximately 5 to 10 mm.

BRIEF DESCRIPTION OF THE DRAWINGS

FIG. 1A is a side elevation view of a device for stimulating the muscles in the leg region according to a first embodiment of the invention.

FIG. 2A is a top plan view of the device shown in FIG. 1A.

DESCRIPTION OF THE PREFERRED EMBODIMENT

Figure 1B:
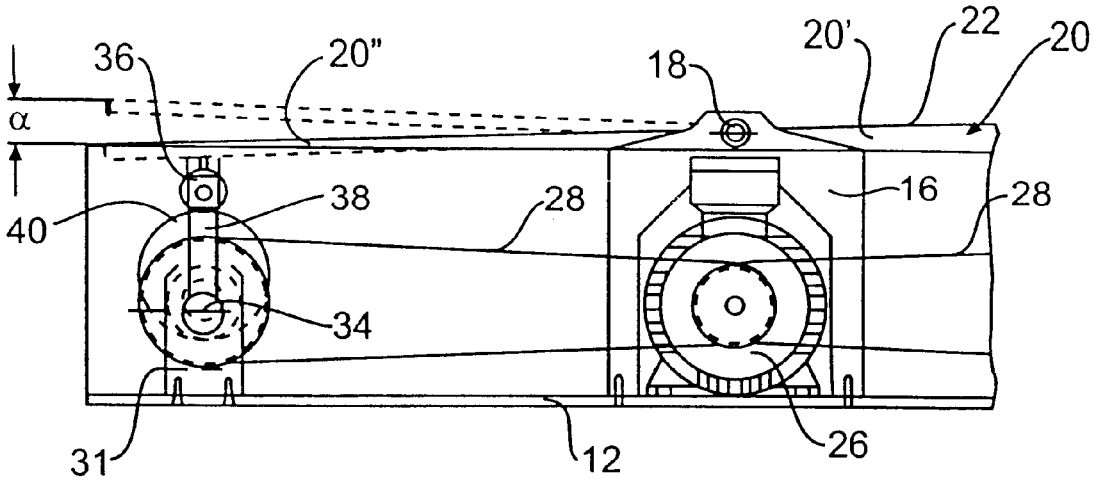
FIG. 1B is an enlarged sectional view of part of FIG. 1A.
Figure 2B:
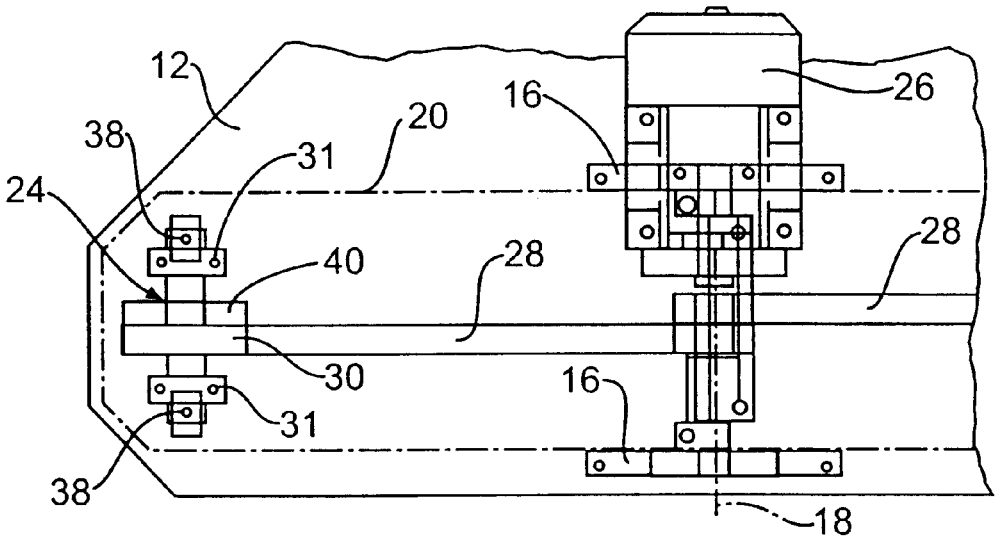
FIG. 2B is an enlarged section of FIG. 2A.

Referring initially to FIG. 1A, an embodiment of the invention for activating muscles using a body's own mass and internal proprioception is shown. A seesaw is oscillatingly pivotable about a pivot axis on a frame, with arms of the seesaw protruding over the pivot axis and being provided with stepping surfaces. The frame 10, includes a bottom plate 12 having an essentially trapezoidal outline and a support frame 14 that may be detached from the bottom plate as well as a seesaw 20 that may be pivoted about a horizontal pivot axis 18 and that is fixed to the frame 10 at bearing blocks 16. The arms 20', 20" of the seesaw 20, which protrude at both sides over the pivot axis 18, each have an upwardly oriented stepping surface 22. Lifting mechanisms 24 are adapted to be driven by a common speed-controlled electric motor 26 and toothed belt drives 28 in a push-pull manner. The lifting mechanisms 24 are each provided with drive shafts 32 that are rotatably supported in frame-fixed bearings 31 and that carry sprockets or pulleys 30 for engagement with the toothed belt drives 28.

Figure 3:
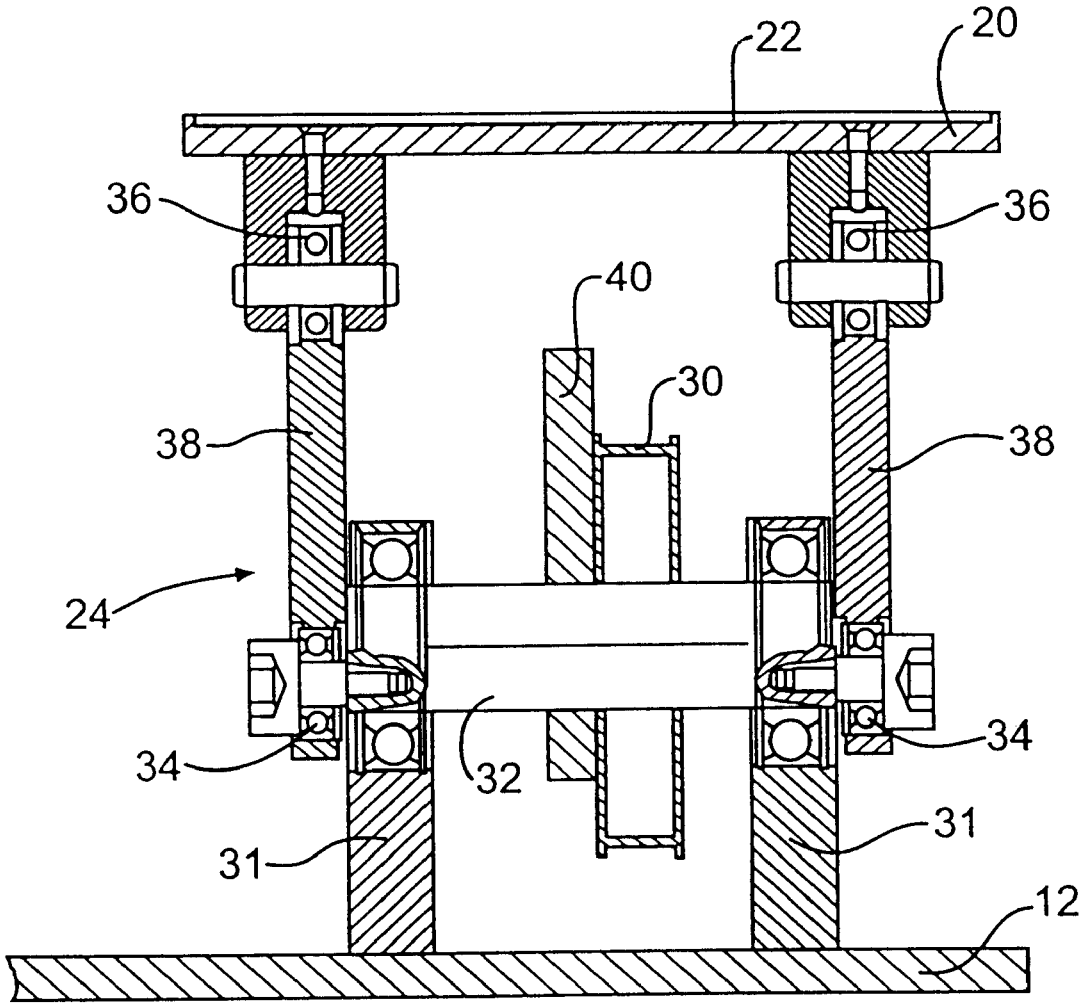
FIG. 3 is a cross sectional view taken along lines 3—3 in FIG. 1B.

As shown in FIG. 3, a pair of connecting rods 38 are eccentrically supported at ends 34 of the drive shafts 32 and are connected at opposite ends 36 to the bottom side of corresponding seesaw arms 20', 20". In order to compensate for imbalances, a massive eccentric disc 40 is additionally disposed on each of the drive shafts 32.

The seesaw 20 oscillates about its pivot axis 18 in a lifting and lowering manner and thereby moves the stepping surfaces 22 of the arms 20', 20" up and down in a push-pull manner by an amount at their outer edges to provide a desired amplitude of activation (shown as a in FIG. 1B) to the portions of a body positioned on the stepping surfaces. A control device 42, shown in FIG. 1A, is disposed in the upper part of the support frame 14 and controls the frequency of oscillation of the seesaw 20 to a predetermined range of frequencies from approximately 1 to 60 Hz., and more preferably from 10 to 30 Hz. The amplitude of oscillation is controlled by the amount of eccentricity of the connection between connecting rods 38 and drive shafts 32 relative to the central axes of drive shafts 32. The amplitude is predetermined to fall within a range of 2 to 50 mm, and more preferably 5 to 10 mm.

When a human body is positioned on the stepping surfaces 20', 20 ", oscillation of the seesaw 20 about pivot axis 18 provides the proper input to the leg muscles of the human body such that the neural pattern characterizing a walking or running movement is stimulated and developed by repetitive cycling. The frequency and amplitude of oscillation of the seesaw 20 stimulate the body's natural involuntary reflexive responses in the leg muscles and allow for rapid development in the muscles.

An involuntary reflexive response or stretch reflex is stimulated in the muscles as a result of the muscles experiencing an increase in load from a baseline load at which the muscles have assumed a base tone, to a peak load, and then back to the baseline load over a period of time too short to allow for a voluntary reaction on the part of the subject. The muscles affected by the input load exhibit a stretch reflex under these conditions as the body either involuntarily, through proprioception, tries to maintain its center of gravity in the same place to avoid losing balance; or the body tries to return a limb to its original position under the baseline load. In order to stimulate the desired involuntary reflexive responses according to the present invention, the muscles must preferably be moved through a range of amplitudes from 2–50 mm, and more preferably 5–10 mm. The frequency of activation must preferably be in the range from 1–60 Hz, and more preferably 10–30 Hz, with each cycle including the time from the baseline load to peak load and back to baseline load, and the time before the next activation.

Figure 4:
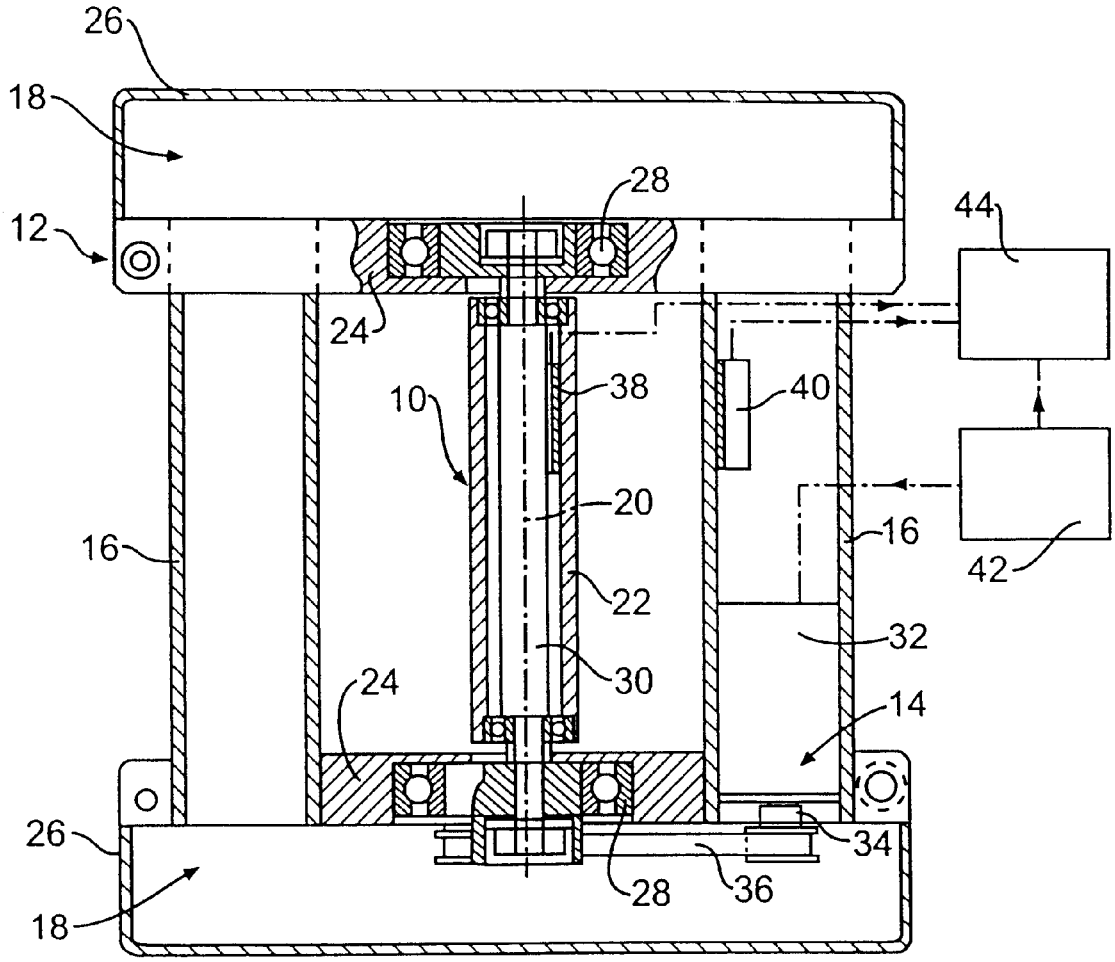
FIG. 4 is a cross sectional view through a dumbbell according to a second embodiment of the invention.

Referring to FIG. 4, an embodiment of the invention is shown wherein oscillatory movements of an external mass in accordance with an aspect of the invention can be superimposed upon muscles of the body affected by use of a dumbbell. Known dumbbells are used both in body building and medical rehabilitation to strengthen the muscles of the arms, shoulders, chest and other portions of the upper torso. The dumbbell can be held in the hand and moved by muscular force along with a swiveling movement of the wrist, elbow, and shoulder joints and controlled by the central nervous system. A dumbbell according to an aspect of the present invention can maximize the benefits obtained by the use of the dumbbell while minimizing possible stresses and damage associated with conventional dumbbells.

Figure 5:
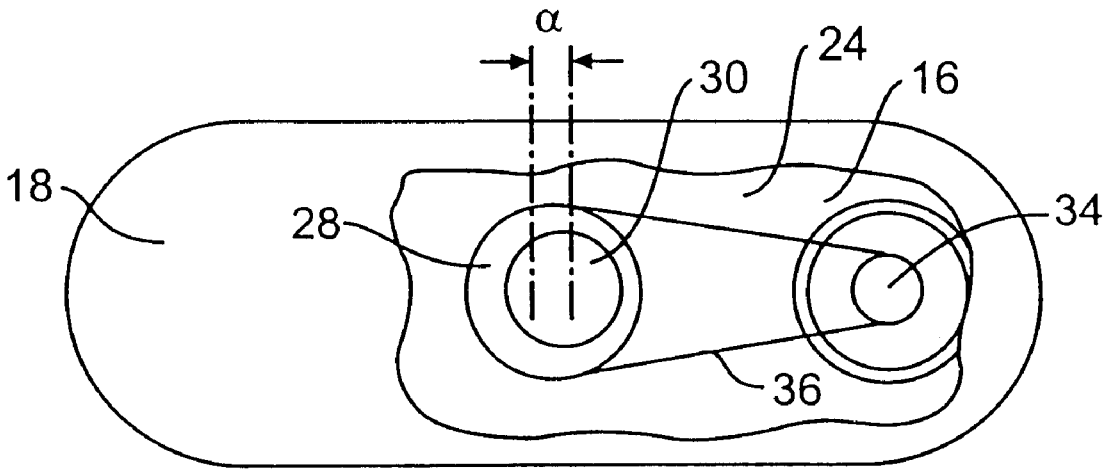
FIG. 5 is a partially cut away view taken along lines 5—5 in FIG. 4.

With the dumbbell device according to an aspect of the invention a baseline input force is provided by the dumbbell's own weight and inertia. As shown in FIGS. 4 and 5, a dumbbell is provided with a gripping part 10, a mass element 12 connected to the gripping part 10, and a drive mechanism 14 for the production of an oscillatory movement between the mass element 12 and the gripping part 10. The dumbbell can be grasped at gripping part 10 and brought into a prescribed position relative to the body by rotating the wrist, the elbow joint and the shoulder joint. When an oscillatory movement between the mass element 12 and the gripping part 10 is produced via the drive mechanism 14, forces that are due to the mass and that consequently affect the hand must be accommodated by the musculature of the arm via the action of the central nervous system. A proper frequency and amplitude of input to the arm muscles by the oscillatory movement results in an involuntary natural reflexive response of the arm muscles. Consequently, the reflexive responses of the musculature are superimposed upon the baseline tone of the muscle produced by supporting the dumbbell mass, thus allowing development of the muscles and associated neural patterns while producing the least amount of stress possible to the heart and circulatory systems.

The drive mechanism is controlled by a control unit 42 with a frequency that is adjustable as desired. The oscillation frequency is adjustable within a frequency range of approximately 1 to 60 Hz, or more preferably, 10 to 30 Hz.

The mass element 12 is constructed in the form of a frame with two support columns 16 that are arranged at a distance from one another and that are aligned parallel to one another. Two cross pieces 18 connect the ends of the support columns 16 in parallel relation and gripping part 10 has a gripping sleeve 22 that is arranged in the region between the support columns 16 and that is parallel to the support columns. Gripping part 10 is movable in an oscillatory manner relative to cross pieces 18 and support columns 16.

Each of the cross pieces 18 includes a support plate 24 connected to support columns 16 and a support cover 26 that covers support plate 24. Eccentric rotary bearings 28 are arranged in the support plates 24 and rotatably support motor-driven cam shaft 30 off axis from the central axis of mass element 12. The amount of eccentricity of cam shaft 30 relative to the central axis of mass element 12 determines the amplitude of the oscillatory motion of gripping part 10. Gripping sleeve 22 is arranged on cam shaft 30 in order to permit rotation of the gripping sleeve about the gripping axis 20.

As shown in FIG. 4, the drive mechanism 14 includes a speed-regulated electric motor 32 arranged in a cavity in one of the support columns 16. A driven shaft 34 connected to the electric motor 32 is parallel to the support columns 16. A belt or chain 36 is arranged between the driven shaft 34 and the cam shaft 30. As best seen in FIGS. 4 and 5, the gripping part 10 moves in an eccentric manner with a stroke (a) within the frame-like mass element 12. An oscillatory movement of the center of gravity of the mass element 12 thus results in the mass of the dumbbell being moved in a direction transverse to the gripping axis with an amplitude (a) when the dumbbell is held by gripping part 10. This eccentric movement results in an oscillatory input to the muscles of the arm at the desired frequency and amplitude in order to stimulate involuntary natural reflexive responses from the muscles of the arm. As a result of the force of gravity, the dumbbell mass itself produces a basic tone in the musculature of the arm depending on the position of the arm, with the basic tone being superimposed on the forces generated by oscillatory movement of the mass element 12. As a result of a body's proprioception and developed neural patterns, the muscles of the arm exhibit involuntary reflexive responses to the oscillatory movement of the dumbbell.

The structure whereby the gripping portion is mounted eccentrically relative to a central axis of a motor-driven shaft such that the gripping portion rotates about the central axis of the mass element provides significant benefits over rotating an eccentric mass about the gripping portion. With the rotating gripping portion of the present invention, the dumbbell can be placed on a surface while still operating without causing excessive vibrations to the surface since the rotating mass of the gripping portion is very small compared to the overall mass of the dumbbell. Furthermore, mass can be easily added or removed from the dumbbell to affect the force imposed by the oscillation of the gripping portion relative to the mass.

Acceleration sensors 38, 40 can be arranged in the gripping part 10, as shown in FIG. 4, in order to enable diagnostic evaluation of the user of the dumbbell. Output signals from the acceleration sensors can be correlated in a computer-controlled evaluation circuit 44 with the movement data from the drive mechanism 14 in order to produce an analysis of the user's musculature response.

It will be apparent to those skilled in the art that various modifications and variations can be made in the method for stimulating muscles of the present invention and in construction of the devices for imparting the oscillatory motion to the muscles without departing from the scope or spirit of the invention. As an example, instead of the oscillatory input to the muscles of the arm provided by the dumbbell of the second embodiment, a similar oscillatory input could be provided to any other muscles of the body by superimposing the oscillatory motion on gripping portions of other progressive resistance exercise machines or by superimposing the motion on the pedals or stepping surfaces of exercise bicycles or stair climbing machines. As an example, a similar mechanism to the motor-driven eccentric mass of the dumbbell could be mounted on or connected to the gripping portions of an exercise machine for performing "chest flies" such as the pectoral machine sold under the trademark "NAUTILUS". A rotating eccentric mass would superimpose a cyclical force on the baseline force resulting from the weight stack connected through cables and pulleys to the gripping portions of the machine. The pectoral muscles and arm muscles involved in performing "flies" with the pectoral machine would assume a base tone as a result of the static weight on the weight stack. Activation of the eccentric mass at the proper amplitude of motion and the proper frequency would stimulate involuntary reflexive responses from the involved muscles. The rotary motion of the eccentric mass (or eccentric gripping part relative to a mass) as disclosed above for the dumbbell embodiment could also be replaced with a linear reciprocating motion. Such a modification would result in a device according to the present invention that superimposes a cyclical force of proper frequency and amplitude to stimulate reflexive responses from the involved muscles along a single axis rather than along multiple axes. It will also be recognized by a skilled artisan that the actual mechanisms for imparting the cyclical forces can be varied as long as the range of frequencies of activation fall between 1 and 60 Hz, and more preferably between 10 and 30 Hz, and the range of amplitudes falls between 2 and 50 mm, and more preferably between 5 and 10 mm.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A device for stimulating an involuntary reflexive response in a muscle, comprising:

means for subjecting the muscle to an input force of an initial baseline value so that the muscle assumes a baseline tonus sufficient to induce the muscle's involuntary natural stretch reflex when the input force is modified;

means for controlling the application of a cyclical force to the muscle with the cyclical force having a frequency in the range of 1–60 Hz, sufficient to stimulate the muscle's involuntary natural stretch reflex each time the force on the muscle is reduced from a peak value to the initial baseline value, with one cycle including the time for an increase in the force from a baseline value to a peak value and back to the baseline value and the time the force is maintained at the baseline value before a subsequent increase; and means for controlling the movement of a muscle through an amplitude of displacement in the range of 2–50 mm.

2. The device according to claim 1, wherein said means for controlling the application of a cyclical force to the muscle includes a seesaw platform adapted to support at least a portion of a body that is connected to the muscle; and said means for controlling the movement of the muscle includes a motor-driven drive shaft and a connecting rod having one end pivotally connected to an end of the drive shaft at a distance equal to the desired amplitude of displacement from the central axis of the drive shaft, and having an opposite end pivotally connected to one end of the seesaw platform.

3. The device according to claim 2, wherein said means for controlling the application of a cyclical force controls the application of the cyclical force in the range of 10–30 Hz; and said means for controlling the movement of the muscle moves the muscle through an amplitude of displacement in the range of 5–10 mm.

4. The device according to claim 2, wherein an eccentric mass is mounted on said drive shaft to compensate for imbalances created by the eccentrically mounted connecting rod as the connecting rod rotates about the central axis of the drive shaft.

5. The device according to claim 4, wherein said means for controlling the application of a cyclical force imparts a cyclical force in the range of 10–30 Hz; and said means for controlling the movement of the muscle moves the muscle through an amplitude of displacement in the range of 5–10 mm.

6. The device according to claim 1, wherein said means for controlling the application of a cyclical force to the muscle includes a mass rotatably connected to a motor-driven shaft; and said means for controlling the movement of the muscle includes a gripping portion rotatably mounted for eccentric rotation about the central axis of said motor-driven shaft with the amount of eccentricity of said gripping portion relative to the central axis of said motor-driven shaft being equal to the desired amplitude of displacement of the muscle.

7. The device according to claim 6, wherein said means for controlling the application of a cyclical force controls the application of the cyclical force in the range of 10–30 Hz; and said means for controlling the movement of the muscle moves the muscle through an amplitude of displacement in the range of 5–10 mm.

8. A device for stimulating muscle of a body having a weight, comprising:

a seesaw platform having first and second ends to support the body and being pivotally mounted between said first and second ends to a frame for alternating, vertical oscillatory motion of the first and second ends;

first and second motor-driven drive shafts rotatably mounted adjacent the first and second ends, respectively;

at least one connecting rod being rotatably connected at a proximal end to each of the first and second motor-driven shafts at a point eccentric to the central axis of the respective motor-driven shaft by a distance in the range between 2 and 50 mm and being rotatably connected at a distal end to each of the first and second ends; and a motor that drives the first and second drive shafts to rotate between 1 and 60 revolutions per second, the motor and the at least one connecting rod cooperating to alternately vertically oscillate opposite ends of the seesaw platform such that when the body is supported by the platform the weight of the body provides an input force to the muscle and the body is forced to maintain its balance through proprioception.

9. The device according to claim 8, wherein said proximal end of said at least one connecting rod is connected at a point eccentric to the central axis of the respective motor-driven shaft by a distance in the range between 5 and 10 mm.

10. A device for stimulating muscle, comprising:

a surface that can be fixed in relation to a portion of a body connected to a muscle; and a motion inducing device that imparts oscillating motion to the surface relative to the element, the motion inducing device including:

a drive shaft;

a motor input member coupled to the drive shaft;

a motor coupled to the motor input member;

a disc eccentrically mounted to the drive shaft; and a connecting rod coupled to the drive shaft at a position eccentric to a central axis of the drive shaft.

11. The device of claim 10, further comprising an element that resists motion in at least one direction as a result of forces selected from the group consisting of frictional forces, gravitational forces and inertial forces, the surface moving relative to the element when the motion inducing device imparts oscillating motion to the surface.

12. The device of claim 10, wherein the motor input member comprises:

a pulley coupled to the drive shaft; and a toothed drive belt drivingly engaging the motor and the pulley.

13. The device of claim 10, wherein the disc being adjacent the pulley.

14. The device of claim 8, further comprising:

a first and second motor input member coupled to a respective one of the first and second motor-driven shafts and to the motor; and a first and second disc eccentrically mounted to a respective one of the first and second motor-driven shafts and to the motor.

15. The device of claim 14, wherein the first and second motor input members comprise, respectively:

a first and second pulley coupled to the respective one of the first and second motor-driven shafts; and a first and second toothed drive belt drivingly engaging the motor and a respective one of the first and second pulleys.

16. The device of claim 15, wherein the first and second discs being adjacent the respective one of the first and second pulleys.

* * * * *